United States Patent [19]

Giros

[11] 4,279,372

[45] Jul. 21, 1981

[54] APPARATUS FOR LIMITING THE SIZE OF TURNS OF A HELICALLY FORMED LONG PRODUCT

[76] Inventor: Marcel A. P. Giros, Rte. de Saint-Dizier, 55170 Ancerville, France

[21] Appl. No.: 59,476

[22] Filed: Jul. 20, 1979

[30] Foreign Application Priority Data

Sep. 21, 1978 [FR] France ..... 78 27461

[51] Int. Cl.[3] ..... B65H 17/42; G11B 15/56

[52] U.S. Cl. ..... 226/118; 226/104

[58] Field of Search ..... 226/42, 43, 117–119, 226/168, 104; 242/47.01, 47.04

[56] References Cited

U.S. PATENT DOCUMENTS

| | | | |
|---|---|---|---|
| 3,500,877 | 3/1970 | Lingen et al. | 226/168 X |
| 3,951,322 | 4/1976 | Giros | 226/119 |
| 4,026,450 | 5/1977 | Giros | 226/42 |
| 4,051,986 | 10/1977 | Tiggelers et al. | 226/118 X |
| 4,203,540 | 5/1980 | Giros | 226/119 |

*Primary Examiner*—Leonard D. Christian

*Attorney, Agent, or Firm*—Otto John Munz

[57] ABSTRACT

The invention relates to an apparatus suitable to be used in an installation ensuring the progression of long, flexible and deformable products, said apparatus comprising means for limiting, at will, the size of the turns, which means are adjustable by displacement in a direction substantially perpendicular to that of the progression of the products.

11 Claims, 9 Drawing Figures

APPARATUS FOR LIMITING THE SIZE OF TURNS OF A HELICALLY FORMED LONG PRODUCT

BACKGROUND OF THE INVENTION

1. Field of the Invention

An apparatus suitable to be used in an installation ensuring the progression of long, flexible or deformable products in the form of helical turns, by means of which apparatus it is possible, at will, to regulate the maximum size of the turns, particularly with the purpose of adapting it to the thickness of the progressing product, in order to avoid any entanglement of adjoining turns.

2. Description of the Prior Art

Apparatus are known, into which is introduced a long product, generally made of metal, which product progresses in the form of helical turns suspended from one or more supporting shafts. Such apparatus are applicable to two different objects.

Those apparatus which are positioned upstream of an installation for the treatment of the product serve the purpose of an accumulator or storage unit. They permit the local and momentary stoppage of the material in front of the apparatus, during which the diameters of the turns decrease one after the other in the apparatus. It thus becomes possible to carry out a local operation on the material upstream of the apparatus, for example, the welding or soldering of two successive strips. Once this operation has been carried out, the material is reintroduced into the accumulator or storage unit, which is once again filled with large turns. It is then ready to be emptied a second time for serving a purpose similar to that previously mentioned. A storage unit of the type as indicated above is described in French Pat. No. 2 169 531.

The general purpose of the other apparatus is to permit a mechanical, chemical or electrolytic treatment of the material. In such a case, they comprise one or more successive tanks, of which the end wall is, in certain cases, passed over by a turn straddling the said wall. French Pat. No. 2 185 459 describes a treatment installation, in which the material is suspended from two parallel shafts and of which the mean linear speed of progression may be regulated to be equal with a predetermined speed of extraction of the material. In this installation, momentary or transient contacts of the material on the bottom of the tank are produced, such contacts assuring a certain degree of regularity of the turns. U.S. Pat. No. 4,026,450 describes an installation in which is made a systematic use of the transient contacts of the material, and in this case with one wall of the tank, in order to obtain an automatic regulation of the helical turns.

Even if the judicious use of the transient contacts of the material with the tank has thus made it possible to avoid the entanglement of the turns of the helix formed by the material, the installations according to the prior art, as used for the tubes, strips or wires, these two latter with a thickness greater than 1 mm, have on the contrary been proved to be unsuitable for being used with strips or wires of smaller thickness. It is important in this case that the diameter of the turns is considerably reduced, for avoiding that, on account of the pliability due to the small thickness, the turns are no longer of a regular formation and are not mixed. It would then be necessary either to use the storage units and treatment tanks adapted to the material of larger thickness and to reduce the diameter of the turns, or to use new storage units and tanks of reduced dimensions. The first solution does not permit of bringing into use the considerable progress made by the employment of transient contacts and the second would make necessary the duplication of the installations.

SUMMARY OF THE INVENTION

The invention relates to an apparatus which may be adapted to the existing installations, either of the accumulator type for long, flexible products, or of the type such as those serving for the treatment of these products, that is to say, comprising a treatment tank with a generally acid bath. This apparatus introduces an improvement into the said installations, as a result of which it is possible to select the diameter of the turns within the widest limits, in such a way that the radial rigidity of the said turns, which is itself a function of the thickness of the product, lends itself to carrying out the method involving treatment contacts as previously referred to. Avoided in this way are the dangers of an accidental entanglement of two or more adjacent turns, capable of being swayed because of an insufficiency as regards their lateral rigidity (the case with narrow strips and wires).

The apparatus according to the invention then provides the advantage of permitting the utilisation of a method of transient contacts for strips or wires of which the thickness may be down to half a millimeter.

An apparatus in accordance with the invention is developed for being used in combination with an installation ensuring the progression of a long, flexible or deformable product, such as a strip, wire or tube, formed into helical turns, which installation in particular comprises means for supporting the helical turns, formed of at least one supporting shaft, means for ensuring the rotation of the supporting shaft, means for bringing the long product into the installation and means for extracting it from said installation. The apparatus according to the invention comprises means for limiting the size of the turns, which means are adjustable by displacement in a direction substantially perpendicular to that of the progression of the product.

According to one particular feature of the invention, the said adjustable means are preferably formed by a cage having movable side walls, which is open in its upper part and also at the front and at the rear. They may also be formed by the movable walls of a tank or trough which is open in its upper part and likewise at the front and at the rear.

As regards a cage, this is preferably formed by at least four arches or bowed members facing one another in pairs, pivoted on a base girder of the cage and connected by a plurality of bearers which are parallel to one another and are preferably also parallel to the supporting shaft. Suitable means make possible a modification of the mutual distance between the side walls of the cage, thereby limiting the space within which the turns can be developed. The said means are formed by at least two guide rails at an inclination to the vertical, disposed on either side of the cage, on each of which rolls a lateral roller mounted to be free close to the upper edge of the said cage and preferably on one arch or bowed member. A mechanism permits the lateral rollers to be caused to roll on the inclined rails, and thus for the cage to be partially closed, while causing it to ascent towards the shaft from which is suspended the material in the form of helical turns. By this movement of the cage, the volume within which the turns are able to develop is reduced and it is possible to adapt this volume to the optimum diameter of the said turns, so that it is best possible to carry out the process as regards the automatic regulation by transient contacts on the sides of the cage.

The invention visualises two different mechanisms, depending on whether the apparatus is designed for being employed with an accumulator or storage unit, i.e. without a treatment bath, or with a tank or trough including a treatment bath. In the first case, the mechanism making possible the rolling of the rollers on the rails is formed by driving means by which a vertical rod is driven in rotation, one end of the said rod being screwed into a threaded tapping of the bottom girder of the cage. The rotation of the rod causes the upward movement of the bottom girder of the cage, which itself causes the rolling of the rollers in the guide rails and the reduction in size of the cage. In the second case, the mechanism making possible the rolling of the rollers on the rails is formed by hydraulic jacks positioned externally of the treatment tank, so as not to be under attack, either by the projections or by the vapours from the bath. The said jacks operate on a rod fixed on the cage and initiate the upward or downward movement of the rollers in the guide rails, with a corresponding movement for the restriction or the opening up of the cage.

DESCRIPTION OF THE PREFERRED EMBODIMENT

Figure 1:
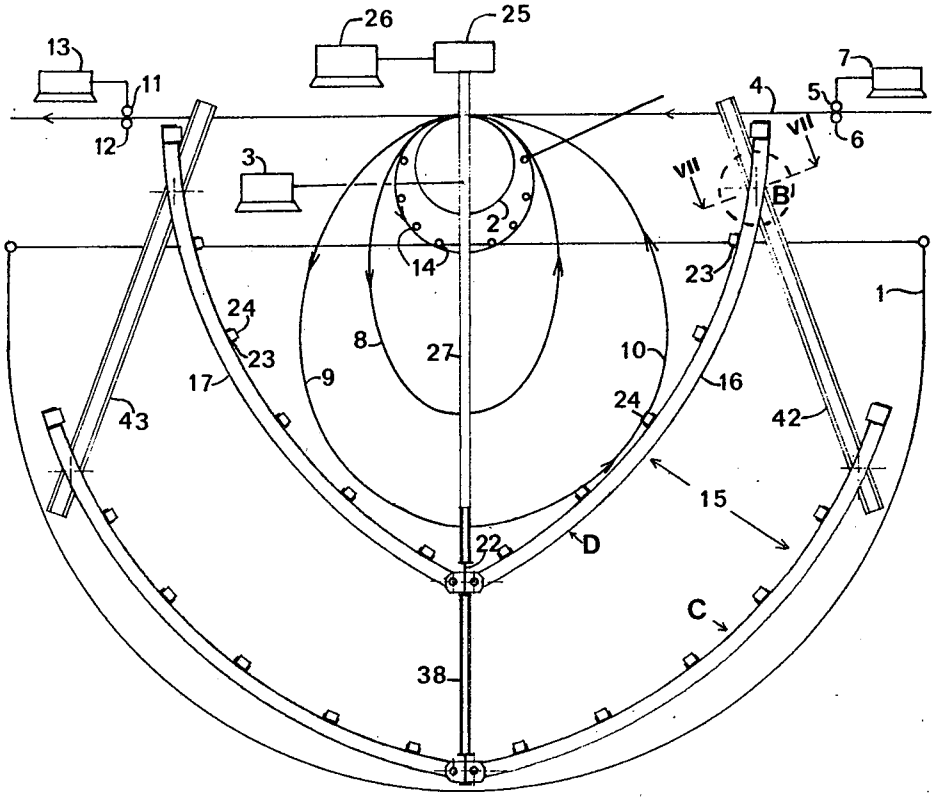
FIG. 1 is a transverse sectional view on the line I—I of FIG. 2, of an apparatus according to the invention.
Figure 2:
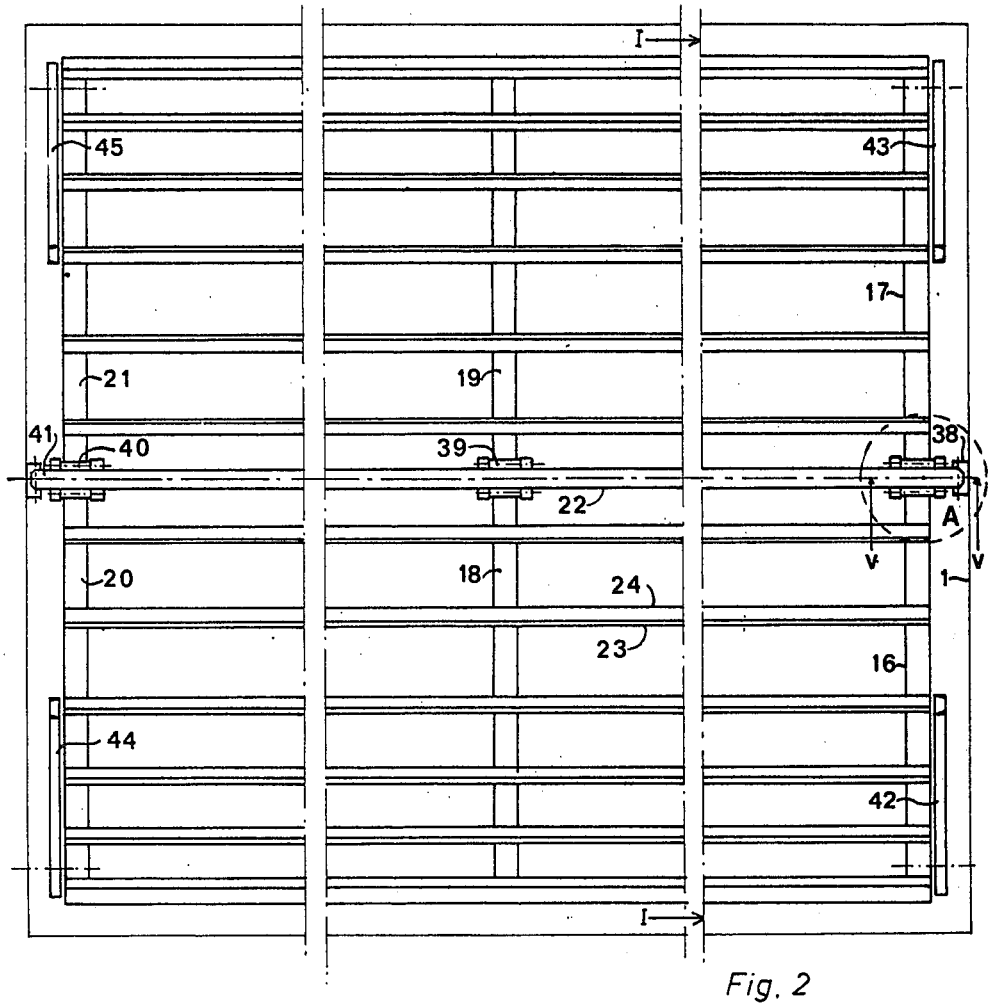
FIG. 2 is a top view of the same apparatus.
Figure 3:
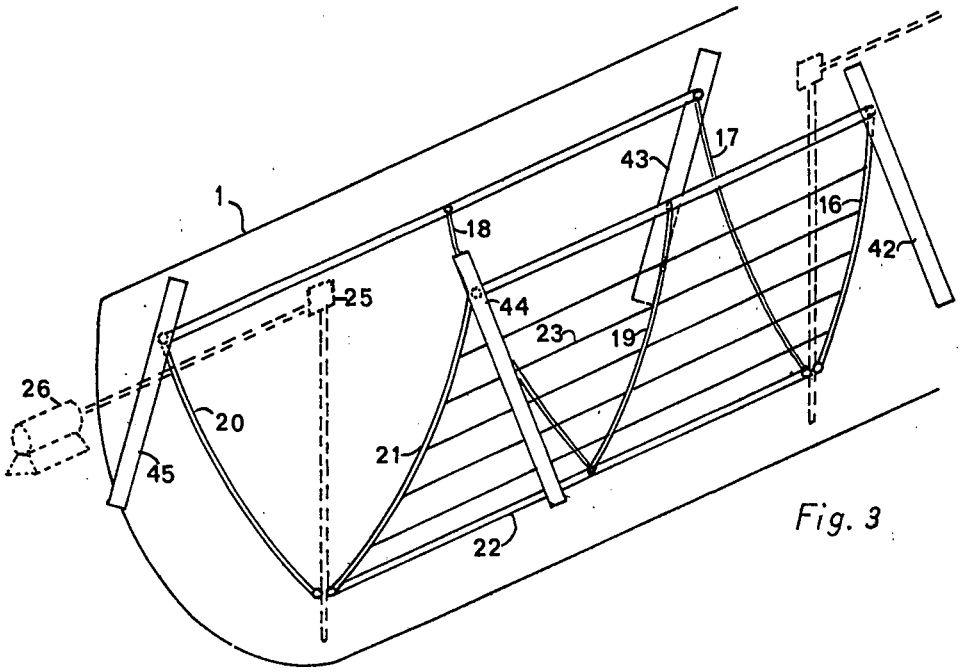
FIG. 3 is a perspective view of the apparatus in the preceding figures.

FIGS. 1, 2 and 3 show an apparatus in accordance with the invention, which is installed in an accumulator or storage unit, i.e. without a treatment bath. This storage unit comprises a tank or trough 1 and a supporting shaft 2 which is driven by driving means 3. A long, flexible product, for example, a metal strip 4 of small thickness, is introduced into the apparatus by driving rollers 5, 6, which are set in rotation by driving means 7. In the storage unit, the strip 4 forms a plurality of turns 8, 9, 10, and is extracted by driving rollers 11, 12 which are set in rotation by driving means 13. Bars or rods 14, parallel to the supporting shaft 2, limit the minimum size of the turns. The accumulator or storage unit as described above, as well as the elements which form it and the method in which it operates, are known.

Figure 6:
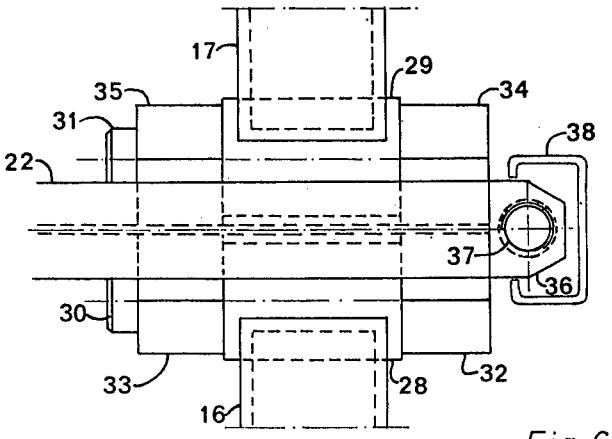
FIG. 6 is a top plan view, to the same scale as FIGS. 4 and 5, of the part A of FIG. 2.
Figure 4:
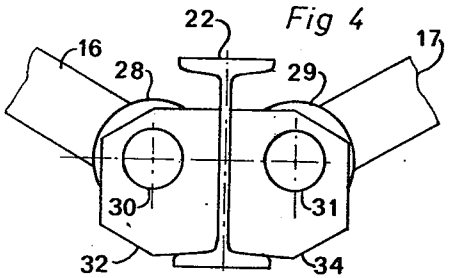
FIG. 4 is an end view, to a larger scale, of the hinge-ing of the arches or bowed members to the part A of FIG. 2.
Figure 5:
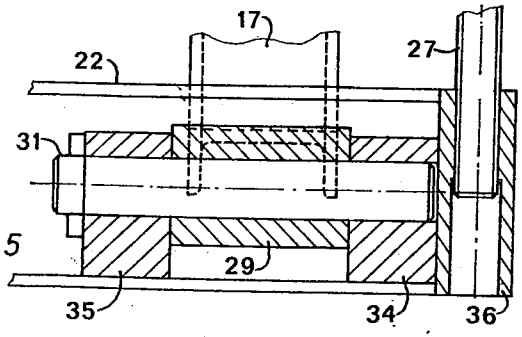
FIG. 5 is a sectional view according to V—V of FIG. 2, to the same scale as FIG. 4.

An apparatus according to the invention is shown in two positions in FIG. 1: the low position C and the high position D. It is formed by a cage 15 consisting of six ribs 16, 17, 18, 19, 20, 21, which are here arcuately formed and are pivoted on a base girder of the cage 22 and a plurality of parallel bearers 23. In this case, the said bearers are U-section members into which are fitted parallelepipedic bars 24 made of wood. It is on the said bars that the transient contacts of the product are produced. It was in fact established that wood was perfectly suitable in connection with an apparatus according to the invention employed in a storage unit, the transient contacts of the long product causing only a negligible degree of wear on the wood. It is obvious that, in the case where the apparatus would be used in a chemical treatment installation, for example, with an acid bath, the bars made of wood would be replaced by inert elements, for example, by electro-ceramic bars, as indicated in U.S. Pat. No. 4,026,450 referred to above. In this case also, all the metallic parts of the apparatus would be covered by sheaths of a material incapable of being attacked by the treatment liquids, for example, PVC. Another solution consists in using a like material which cannot be attacked by acids, for example, a polyester resin, for all the elements of which the cage is constituted, this making unnecessary the use of bars fitted into the the bearers, the contacts of the treated product occuring directly on the said bearers. The limitation of the development of the turns is assured by the product bearing against the bars 24, it being possible for the cage to assume any position between the positions C and D. The travel of the cage from the position C to the position D, or to any other intermediate position, and vice versa, is controlled by a mechanism 25 which is driven by a motor 26 and which acts on a threaded rod 27. The hingeing of the arcuately curved members 16, 17, 18, 19, 20, 21 on the base girder of the cage 22 is indicated in FIGS. 4, 5 and 6. It is to be seen in these figures that, at the ends of the members 16 and 17, for example, are mounted cylindrical ball-joints 28, 29 permitting their rotation about shafts 30, 31, each engaged between two plates 32, 33 and 34, 35 which are fast, for example by welding, with the cage base girder 22. The end 36 of the girder 22 (FIG. 6) has a threaded tapping 37 formed therein, of the same pitch as the threaded rod 27 and in which the said rod can turn under the action of the mechanism 25. Another solution would consist in equipping, for example, by welding, the end of the cage bottom girder with a nut threaded with the pitch of the rod 27. A vertical section member 38 ensures the guiding of the end 36 of the girder 22 when it is being driven vertically by the rod 27.

To be seen in FIG. 2 are pivots or joints 39 and 40, identical with that which has just been described, connecting the members 18 and 19, on the one hand, and 20 and 21, on the other hand, to the base girder 22. The end 41 of the girder 22, opposite to A, is itself also provided with a driving device (not shown) comprising a threaded rod and a guiding section member, which is under the action of a mechanism similar to the mechanism 25. This mechanism is either driven by a motor turning in synchronism with the motor 26, or driven by this latter. Another solution as regards the driving of the two mechanisms may be to couple them to the driving motor 3 of the supporting shaft 2.

Figure 7:
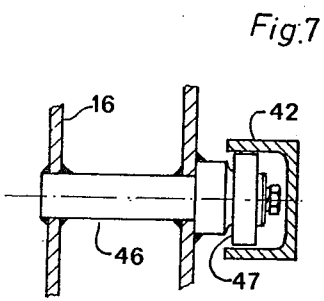
FIG. 7 is a detailed view, as a section along VII—VII and to a larger scale, of a part B of FIG. 1.

The means by which the two sides of the cage can be displaced in a direction substantially perpendicular to that of the progression of the product, so as to reduce the internal volume of the said cage, comprise lateral rails, of which there are here four 42, 43, 44, 45, which are symmetrical in pairs. Rolling on these rails are rollers mounted close to the upper end of each member, thus providing four identical movable connections. One of these latter is shown in detail in FIG. 7. To be seen in this figure, in section, is a lateral rail 42, formed by a member of U-section. The member 16 is provided with a gudgeon 46, at the end of which can turn an idle roller 47. The inclination of the rails 42, 43, 44, 45, from bottom to top, towards the longitudinal axis of the cage, ensures the constriction of the internal volume of the latter, when it passes from the position C to the position D.

Figure 8:
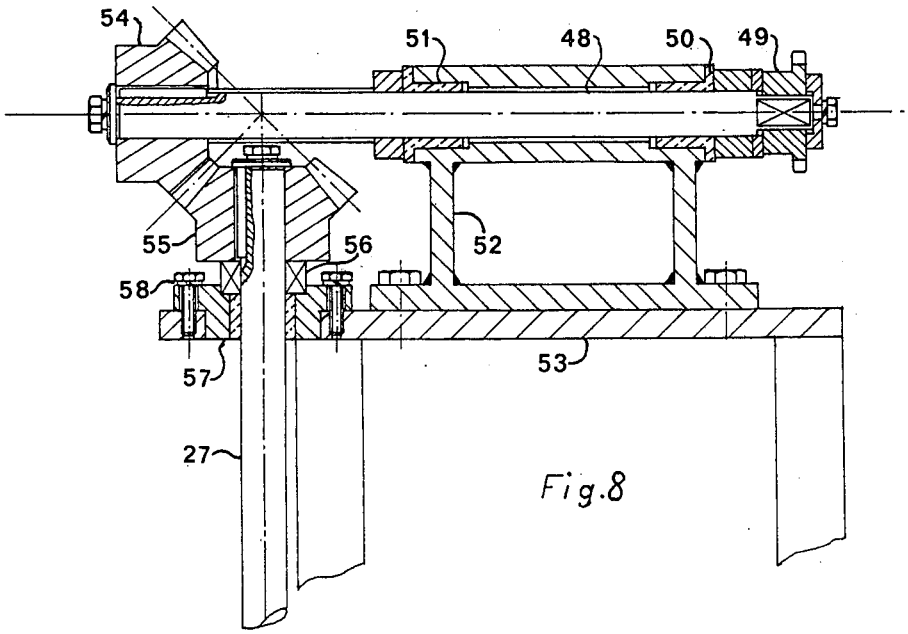
FIG. 8 is a sectional view of one constructional form of the mechanism for driving the rollers.

FIG. 8 shows one embodiment of a mechanism for driving the threaded rod 27, the rotation of which causes the bottom girder of the cage 22 to ascend. A shaft 48 carries, at its end, a chain wheel 49 which can be driven by a chain and the motor 26, not shown herein. The shaft 48 is held by two bearings 50 and 51 which are supported by a chassis 52, which is itself fixed to a frame 53. Keyed on the end of shaft 48 is a conical gear 54, engaging in another conical gear 55, which is itself keyed to the upper end of the threaded rod 27. The threaded rod 27 turns in a bearing 56 of a base member 57 fast with the frame 53 by bolts 58. The rotation of the shaft 48 thus causes the rotation of the threaded rod 27. A mechanism identical with that which has just been described is mounted at the other end of the cage.

Figure 9:
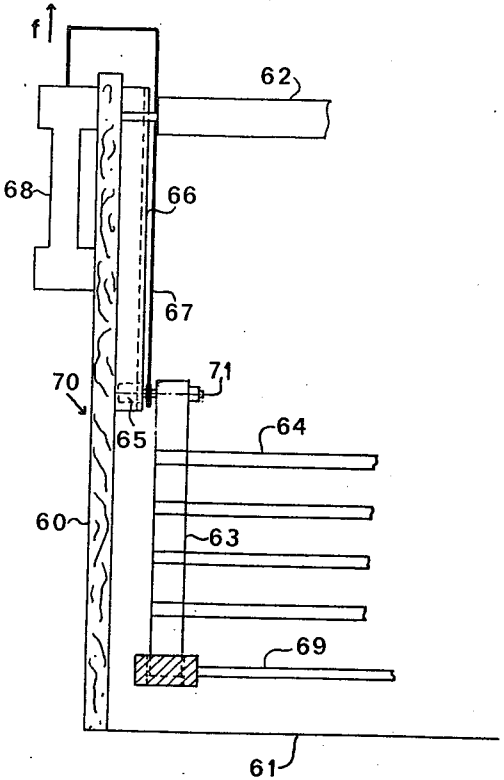
FIG. 9 is a view of another constructional form of the roller-driving mechanism.

Illustrated in FIG. 9, as a partial section, is a treatment or processing tank 70, of which is to be seen a vertical wall 60 and a base 61. Shown at 62 is a supporting shaft for long and flexible material which is to be treated in the tank 70. The said tank is equipped with an apparatus according to the invention, comprising a cage, of which is shown a member 63, hinged on a cage base girder 69, and bars 64. A roller 65 mounted at the end of the cage on a gudgeon 71, is able to roll in a guide rail 66 connected to the tank 70. A twice-bent rod 67 connects the gudgeon 71 to the piston of a hydraulic jack 68. When the jack 68 is operated in the direction of the arrow "f", it is possible to cause the roller 65 to roll in the guide rail 66 and, as a result, to cause the cage to ascend, thereby closing it in the manner similar to that which has been previously described.

I claim:

1. Apparatus for the mechanical, chemical or electrolytic treatment of a long, flexible and deformable product such as a strip, tube or wire, brought into the form of helical turns, comprising at least one treatment chamber, at least one shaft supporting the product, means for assuring the rotation of the supporting shaft, means for bringing the long product on the shaft and means for extracting said product therefrom, and adjustable means for limiting the size of the turns of the helix, wherein said adjustable means comprise a cage having two side walls of at least four members which are symmetrical in pairs, said cage having a bottom cage girder, and said at least four members pivoted on the bottom cage girder, a plurality of parallel bearers mounted on the members, and means for modifying the distance of the side walls from one another comprising at least one lateral roller, a lateral guide rail on which the roller is able to roll and means for causing the lateral roller to roll on the guide rail.

2. Apparatus suitable to be used in an installation ensuring the progression of long, flexible and deformable products in the form of helical turns comprising means for limiting the size of the turns wherein said means are adjustable in a direction substantially perpendicular to the direction of the progression of the product and are formed by a cage having two side walls pivoted on pivoting means of the cage bottom and by means for modifying the distance of the side walls of the cage from one another.

3. Apparatus as in claim 2, wherein the means for modifying the distance of the side walls from one another comprise, on each side of the cage, at least one lateral roller and a lateral guide rail on which the roller is able to roll, and means for causing the lateral roller to roll on the lateral guide rail.

4. Apparatus as in claim 3, wherein a shaft is connected to the side wall and the lateral roller is freely mounted on the shaft.

5. Apparatus as in claim 3, wherein the means for causing the lateral roller to roll on the lateral guide rail comprise a threaded rod and a nut fitted on the screw-thread of the rod, said nut being fast with the cage, and means for causing the threaded rod to turn on itself in the nut.

6. Apparatus as in claim 3, wherein said means for causing the lateral roller to roll on the lateral guide rail are formed by a jack and a rod connecting the jack to the upper part of the cage.

7. Apparatus as in claim 5, wherein the two side walls of the cage are formed of at least four members which are symmetrical in pairs, said cage having a bottom cage girder, said at least four members are pivoted on the bottom cage girder, and a plurality of parallel bearers are mounted on the members.

8. Apparatus as in claim 7, wherein wooden bars are mounted on the bearers on the side internally of the cage.

9. Apparatus as in claim 7, wherein all the elements which constitute the cage are covered with a covering which cannot be attacked by acids and are of the PVC type.

10. Apparatus as in claim 7, wherein the parallel bearers are provided on their surfaces inside the cage with an electro-ceramic coating.

11. An accumulator or storage unit for a long, flexible and deformable product, such as a strip, tube or wire, brought into the form of helical turns, comprising at least one supporting shaft of the product, means for assuring the rotation of the supporting shaft, means for bringing the long product on the shaft, means for extracting said product therefrom, and adjustable means for limiting the size of the turns of the helix, said adjustable means comprising a cage having two side walls of at least four members which are symmetrical in pairs, said cage having a bottom cage girder, said at least four members pivoted on the bottom cage girder, a plurality of parallel bearers mounted on the members, and means for modifying the distance of the side walls from one another, comprising at least one lateral roller, a lateral guide rail on which the roller is able to roll and means for causing the lateral roller to roll on the guide rail.

* * * * *